US007856777B2

(12) United States Patent
Lamfers et al.

(10) Patent No.: US 7,856,777 B2
(45) Date of Patent: Dec. 28, 2010

(54) CLIP ARRANGEMENT FOR WALL PANEL TILES

(75) Inventors: Alex Lamfers, Jenison, MI (US); David Koning, Holland, MI (US)

(73) Assignee: Haworth, Inc., Holland, MI (US)

( * ) Notice: Subject to any disclaimer, the term of this patent is extended or adjusted under 35 U.S.C. 154(b) by 87 days.

(21) Appl. No.: 11/982,878

(22) Filed: Nov. 6, 2007

(65) Prior Publication Data

US 2008/0104926 A1 May 8, 2008

Related U.S. Application Data

(60) Provisional application No. 60/857,094, filed on Nov. 6, 2006.

(51) Int. Cl.
*E04H 1/00* (2006.01)

(52) U.S. Cl. ..... 52/238.1; 52/79.1; 52/220.7; 52/239

(58) Field of Classification Search ..... 52/239, 52/79.1, 220.7, 238.1, 242, 243
See application file for complete search history.

(56) References Cited

U.S. PATENT DOCUMENTS 4,423,573 A 1/1984 Omholt et al.
4,575,983 A * 3/1986 Lott et al. ..... 52/544
4,685,255 A 8/1987 Kelley
4,704,835 A * 11/1987 Jordan ..... 52/489.1
4,905,428 A * 3/1990 Sykes ..... 52/126.4
5,802,789 A 9/1998 Goodman et al.
5,816,001 A 10/1998 Goodman et al.
5,943,834 A 8/1999 Jeffers et al.
6,000,180 A 12/1999 Goodman et al.
6,009,676 A 1/2000 Feldpausch et al.
6,115,977 A 9/2000 Hornberger et al.
6,131,347 A 10/2000 Hornberger et al.
6,173,545 B1 1/2001 Feldpausch et al.
6,397,533 B1 6/2002 Hornberger et al.
6,684,929 B2 * 2/2004 MacDonald et al. ..... 160/135
6,775,953 B2 8/2004 Burken et al.
6,941,716 B2 9/2005 Kottman

* cited by examiner

*Primary Examiner*—Richard E Chilcot, Jr.
*Assistant Examiner*—Branon C Painter
(74) *Attorney, Agent, or Firm*—Flynn, Thiel, Boutell & Tanis, P.C.

(57) ABSTRACT

A cover tile for releasable cooperation with one side of a wall panel frame. The cover tile has elongate rails fixed to the rear side thereof so that the rail ends terminate adjacent corners of the tile. A pair of connector clips are engaged on the rail for disposition at the corners of the tile. Each connector clip includes a main channel-like body transversely slidably engaged on the rail, and this body has a transversely protruding spring or hook projection for cooperation with an opening in the panel frame. The main body of the clip, in one of the legs of the channel-shaped body, has a transversely deformed positioning tab adapted for cooperation with a positioning notch formed in the rail. The one leg also has a locking tab deformed transversely for cooperation with an edge formed on the respective rail to fixedly positionally secure the clip on the rail in the transverse direction thereof.

16 Claims, 10 Drawing Sheets

CLIP ARRANGEMENT FOR WALL PANEL TILES

CROSS REFERENCE TO RELATED APPLICATION

This application claims the benefit of U.S. Provisional Application No. 60/857,094, filed Nov. 6, 2006, which is incorporated herein by reference in its entirety.

FIELD OF THE INVENTION

This invention relates to an improved construction for a cover tile as associated with an upright space-dividing wall panel.

BACKGROUND OF THE INVENTION

Upright prefabricated wall systems formed by a series of interconnected wall panels, as conventionally utilized for dividing large open areas into smaller work spaces, frequently employ cover tiles or pads attached to opposite sides of an interior upright frame for providing increased flexibility with respect to overall aesthetics, acoustics and practicality of use. The detachable cover tiles, there typically being one or more such cover tiles attached to each side of the panel frame, are conventionally provided with a clip, such as a spring or hook, associated with each corner thereof for engagement within openings associated with the panel frame. While many of the known constructions for the cover tiles and specifically the corner clips have operated satisfactorily with respect to their attachment cooperation between the cover tile and the frame, there is nevertheless a continuing need to provide improved characteristics with respect to the cover tile clips and their cooperation between the cover tile and the frame, particularly with respect to the economies and efficiencies of manufacturer of the clips, their ease of attachment to the tile and their cooperation with the frame, and the compactness of the clips and their cooperation between the tile and frame to provide a desirable overall compact relationship with respect to the assembled wall panel.

Accordingly, it is an object of this invention to provide an improved cover pad or tile which is adapted for releasable attachment to an upright panel frame, and more specifically to an improved clip which mounts on the cover tile for permitting detachable engagement with the panel frame.

According to the present invention, there is provided an improved cover tile for releasable cooperation with one side of an upright wall panel frame. The cover tile has a pair of elongate reinforcing rails fixed to the rear side thereof, which rails extend in parallel relationship adjacent longitudinally extending edges of the cover tile so that the rail ends terminate adjacent the corners of the tile. A pair of connector clips are engaged on each rail adjacent opposite ends thereof for disposition in close proximity to the adjacent corners of the tile. Each connector clip includes a main channel-like body which is transversely slidably moved into engagement with the rail, and this body has a transversely protruding projection formed either as a spring or as a hook for cooperation with an opening formed in the panel frame. The main body of the connector clip, in one of the legs of the channel-shaped body, has a transversely deformed positioning tab adapted for cooperation with a positioning notch formed in the rail to ensure that the connector clip, when engaged on the rail, is properly positioned lengthwise along the rail. The leg of the channel-shaped body also has a locking tab deformed transversely therefrom for cooperation with an edge or shoulder formed on the respective rail to fixedly positionally secure the clip on the rail in the transverse direction thereof during slidable engagement of the clip on the rail. The connector clip is preferably formed as a monolithic one-piece member, as by being deformed from a thin metal sheet or plate, thereby providing significant economies and efficiencies of manufacture, while providing a thin and space-saving compact configuration.

Other objects and purposes of the invention will be apparent to persons familiar with constructions of this general type upon reading the following specification and inspecting the accompanying drawings.

Figure 1:
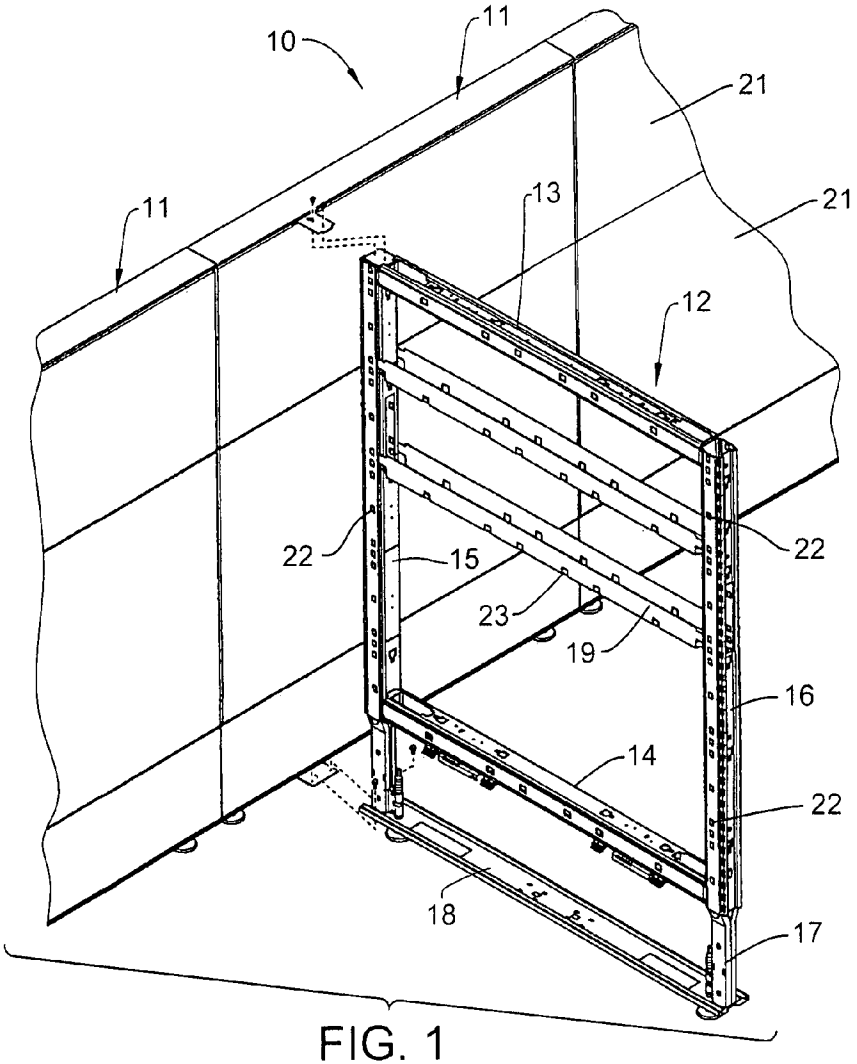
FIG. 1 is a perspective view illustrating several upright panels in relationship for defining an upright wall system, with the various panels being illustrated either with or without cover tiles mounted thereon for convenience of illustration.

Certain terminology will be used in the following description for convenience and reference only, and will not be limiting. For example, the words "rightwardly", "leftwardly", "upwardly" and "downwardly" will refer to directions in the drawings to which reference is made. These terms will also be used with reference to directions which are perceived when the wall panel and/or cover tile is viewed in a normal upright assembled or disassembled condition. The terms "inwardly" and "outwardly" will refer to directions toward and away from, respectively, the geometric center of the wall panel or cover tile, and designated parts thereof. Said terminology will include the words specifically mentioned, derivatives thereof, and words of similar import.

DETAILED DESCRIPTION

Figure 2:
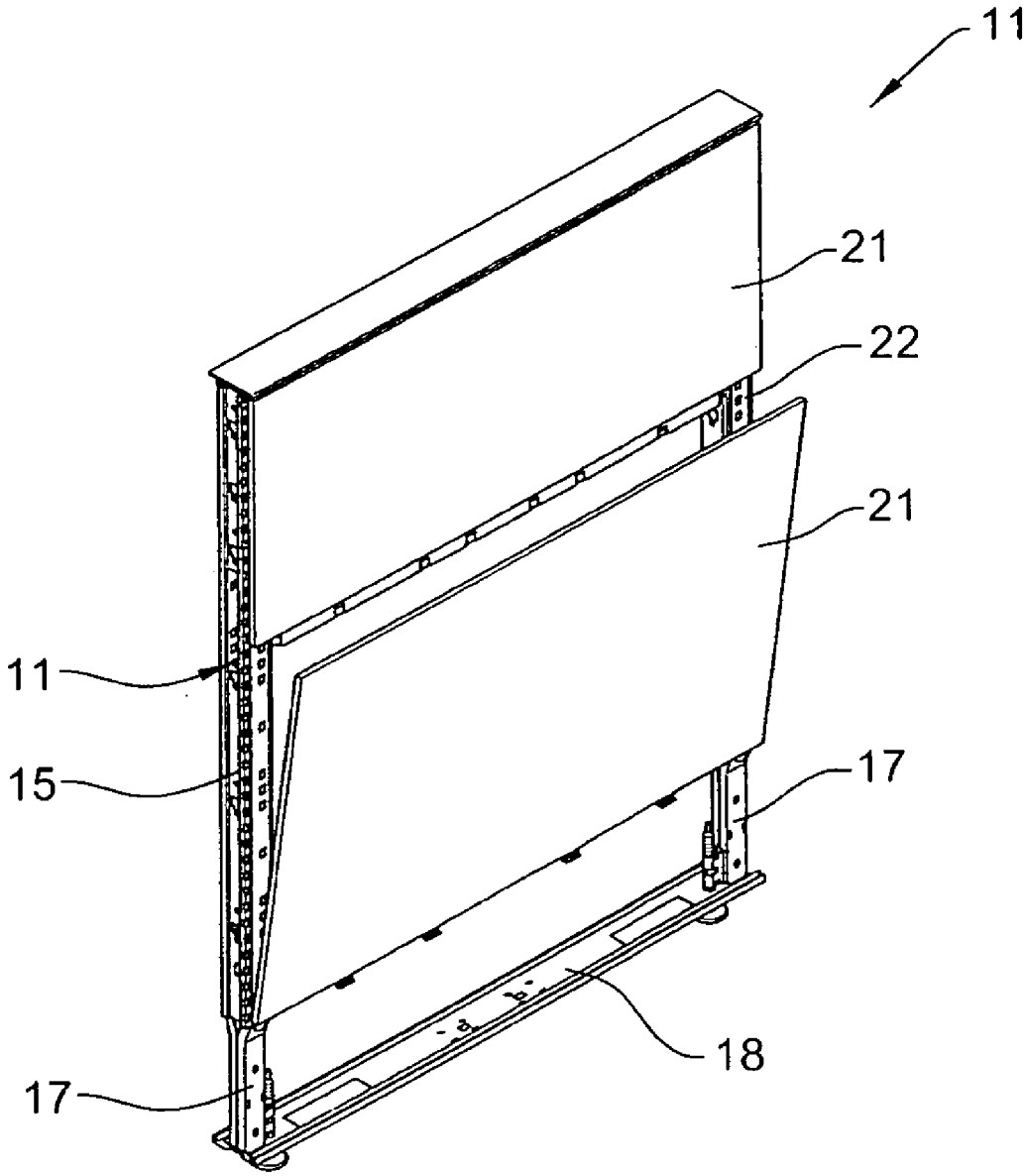
FIG. 2 is a perspective view of an upright wall panel showing a cover tile partially attached to one side thereof.

Referring to FIGS. 1 and 2, there is illustrated a wall system 10 according to the present invention. The wall system 10 is formed by a plurality of prefabricated upright wall panels 11 which, in a conventional manner, can be serially connected in aligned and/or transverse relationship to divide a large open space into smaller work spaces.

The upright wall panel 11 includes an inner upright rigid frame 12 which, in the illustrated embodiment, is formed principally as a ring-shaped rectangular structure having generally parallel top and bottom elongate frame members or rails 13 and 14, respectively, which extend generally horizontally. The frame 12 also includes a pair of generally parallel vertical or upright edge frame members or rails 15 and 16 which extend between and are rigidly joined, such as by welding, to adjacent ends of the top and bottom frame members 13-14. The upright frame members 15-16, in the illustrated arrangement, have lower leg parts 17 which not only mount thereon floor-engaging support glides, but which are also of reduced width to cooperate with an internal chamber formed along the bottom of the wall panel for accommodating power and/or communication cabling, such being a conventional and well known feature in upright wall panels of this general type. The lower leg parts 17, in the illustrated arrangement, are rigidly joined by a bottom pan or member 18 which extends horizontally therebetween and which extends in parallel relationship to the horizontal frame members 13-14. The panel frame 12 is also frequently provided with one or more crossbeams 19 extending at various elevations within the frame and projecting horizontally between the edge uprights 15-16, with the crossbeams 19 being either rigidly or releasably joined to the upright frame members 15-16.

The frame members which make up the frame are preferably formed by elongate hollow members, such as tubular metal members having a square or rectangular cross-section.

The overall constructional details of the frame 12 are explained in greater detail in Provisional Application No. 60/857,098, titled "Structural Top Cap Arrangement for Wall Panel", filed concurrently herewith, owned by the Assignee hereof, and the description of this latter co-pending application is in its entirety incorporated herein by reference. It will be recognized, however, that other conventional constructional features as associated with rigid panel frames can also be utilized and incorporated into the wall panel of this invention without departing from the inventive features as described hereinafter.

The wall panel 11, in accordance with the present invention, is preferably provided on one, and typically both, sides thereof with one or more detachable cover tiles or pads 21. While a single large cover tile can be used to cover an entire side of the wall panel frame, it is typical and conventional to provide two or more such cover tiles on each side of the panel frame, with the cover tiles being disposed vertically one above the other to provide increased flexibility with respect to use and aesthetics.

The cover tile 21 is adapted for releasable engagement on the wall panel frame, and for this purpose, the frame is typically provided with openings in the frame members, such as openings 22 formed through the side walls of the upright frame members 15-16, and/or openings 23 formed through the side walls in the horizontal frame members 13-14. The cooperation of the cover tiles 21 with the frame 12 will be explained in greater detail hereinafter.

Figure 5:
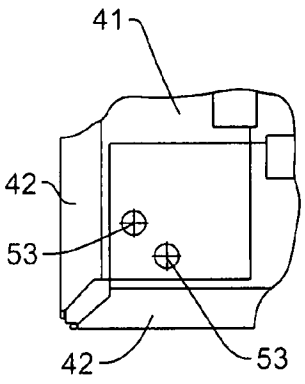
FIG. 5 is an enlarged fragmentary view showing only one corner of the cover tile illustrated in FIG. 3.
Figure 4:
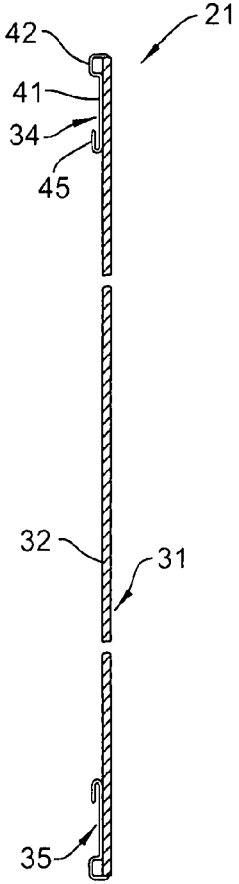
FIG. 4 is a cross-sectional view through the cover tile as taken generally along line 4-4 in FIG. 3.
Figure 3:
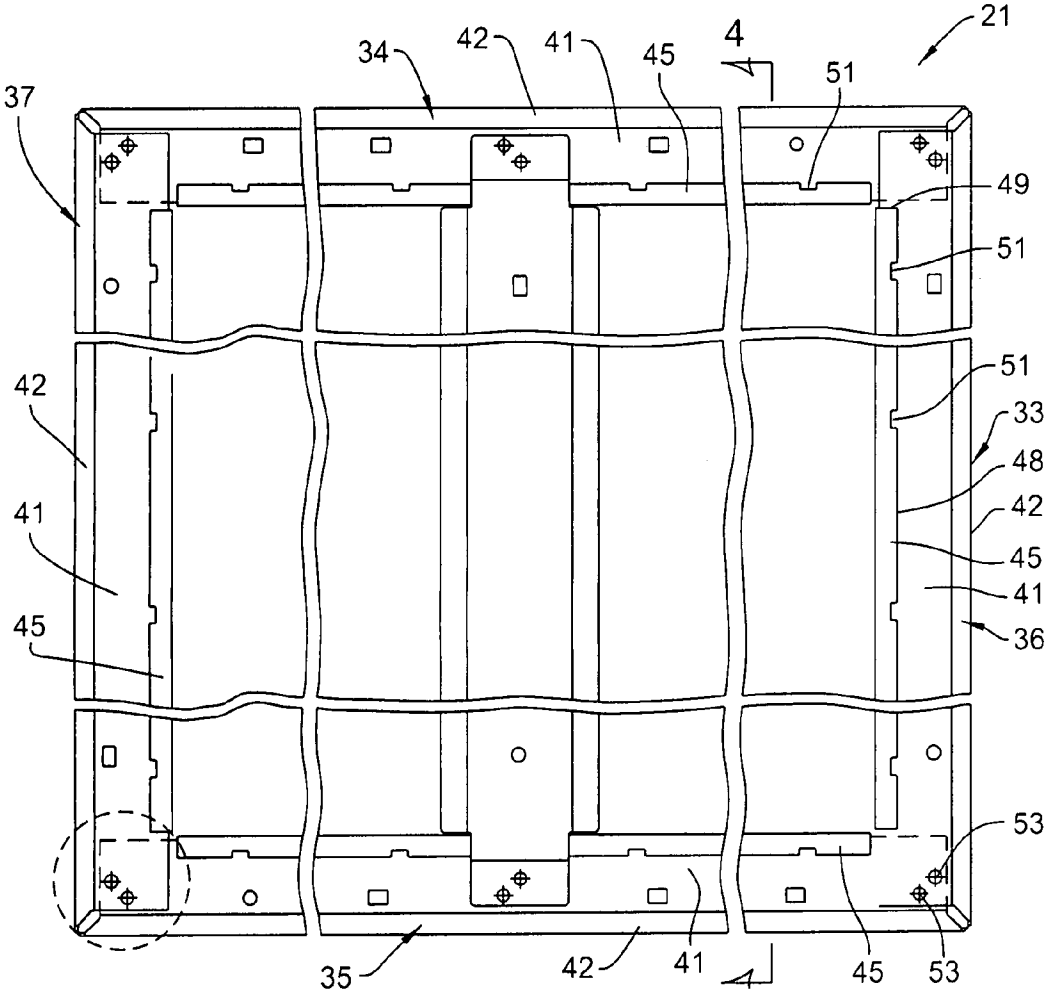
FIG. 3 illustrates the back side of a cover tile prior to mounting of connector brackets thereon.

The cover tile 21 in accordance with the present invention, as illustrated by FIGS. 3-5, includes a main plate-like pad or substrate 31 which is generally rectangular and has height and width dimensions which are relatively large in comparison to the thickness dimension of the pad. The pad 31 in a preferred embodiment is formed of a compressed fiberglass to create a relatively stiff but thin mat, although it will be appreciated that numerous other conventional materials such as fiber board, hard board, wood or other suitable materials may be used for defining the substrate 31. The substrate or pad 31 has, on the back or inner side face 32 thereof, a reinforcing frame 33 positioned in overlying adjacent relationship, which frame 33 is fixedly related to the pad 31 when the cover tile 21 is fully assembled.

The frame 33 is formed generally as a rectangular ring-shaped structure defined by generally horizontally elongated top and bottom frame elements 34 and 35 respectively, the latter being rigidly joined to generally parallel right and left edge frame elements 36 and 37 respectively which perpendicularly extend between the ends of the horizontal frame elements. The frame 33 is disposed so that the individual frame elements or rails are positioned adjacent and extend lengthwise along the respective outer edges of the substrate 31, and the frame elements adjacent the corner of the frame are rigidly joined together in any conventional manner which, in the illustrated embodiment, involves the use of deformations such as dimples or mushroom-type deformed beads 53 which are provided at each corner of the frame.

Figure 17:
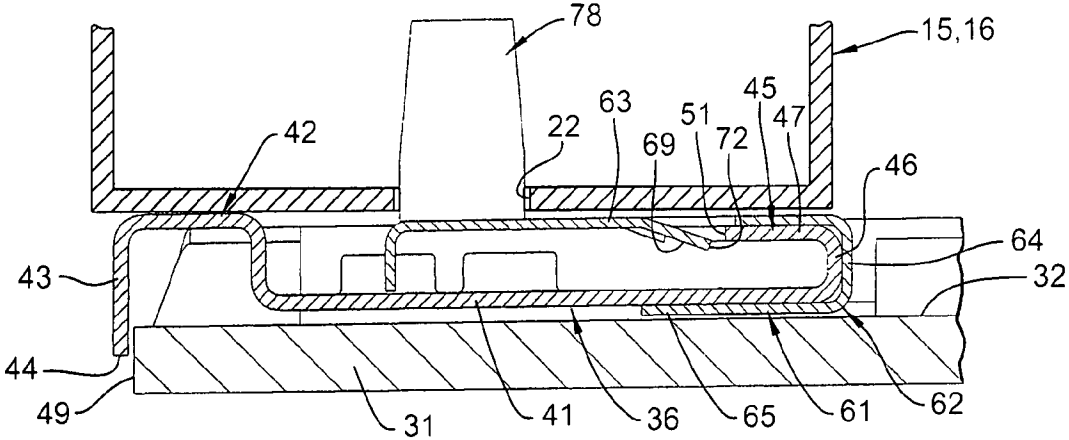
FIG. 17 is a fragmentary, enlarged sectional view taken generally along line 17-17 in FIG. 6 and illustrating the top bracket as attached to the cover tile edge rail.
Figure 20:
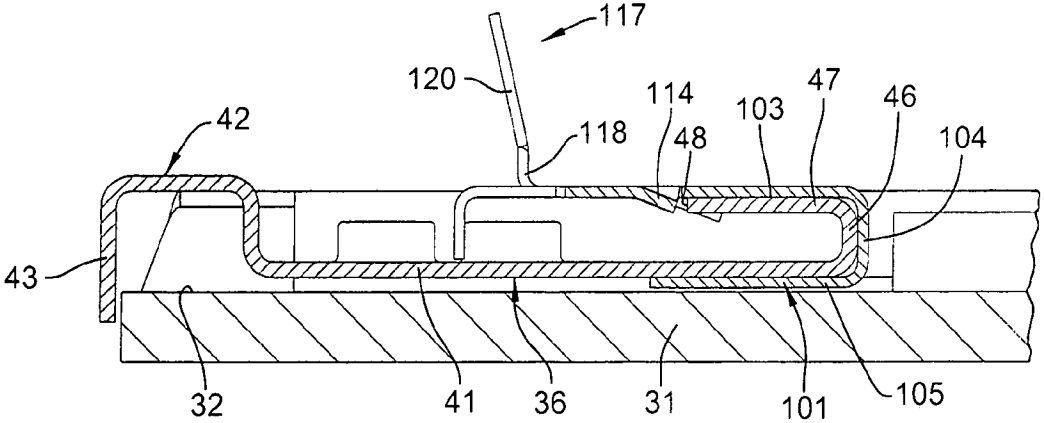
FIG. 20 is a view similar to FIG. 19 but sectioned generally through the locking tab.
Figure 19:
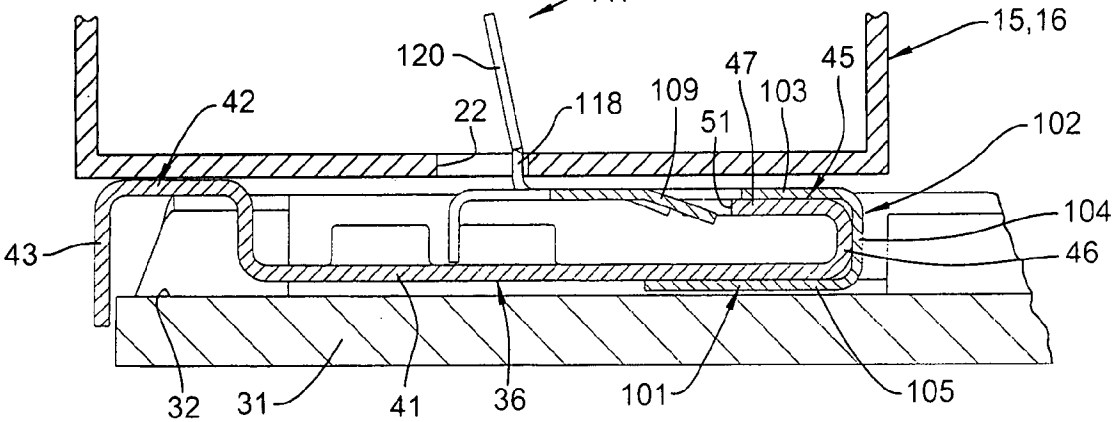
FIG. 19 is a fragmentary, enlarged sectional view taken generally along line 19-19 in FIG. 6 and illustrating the bottom bracket as attached to the cover tile edge rail.
Figure 21:
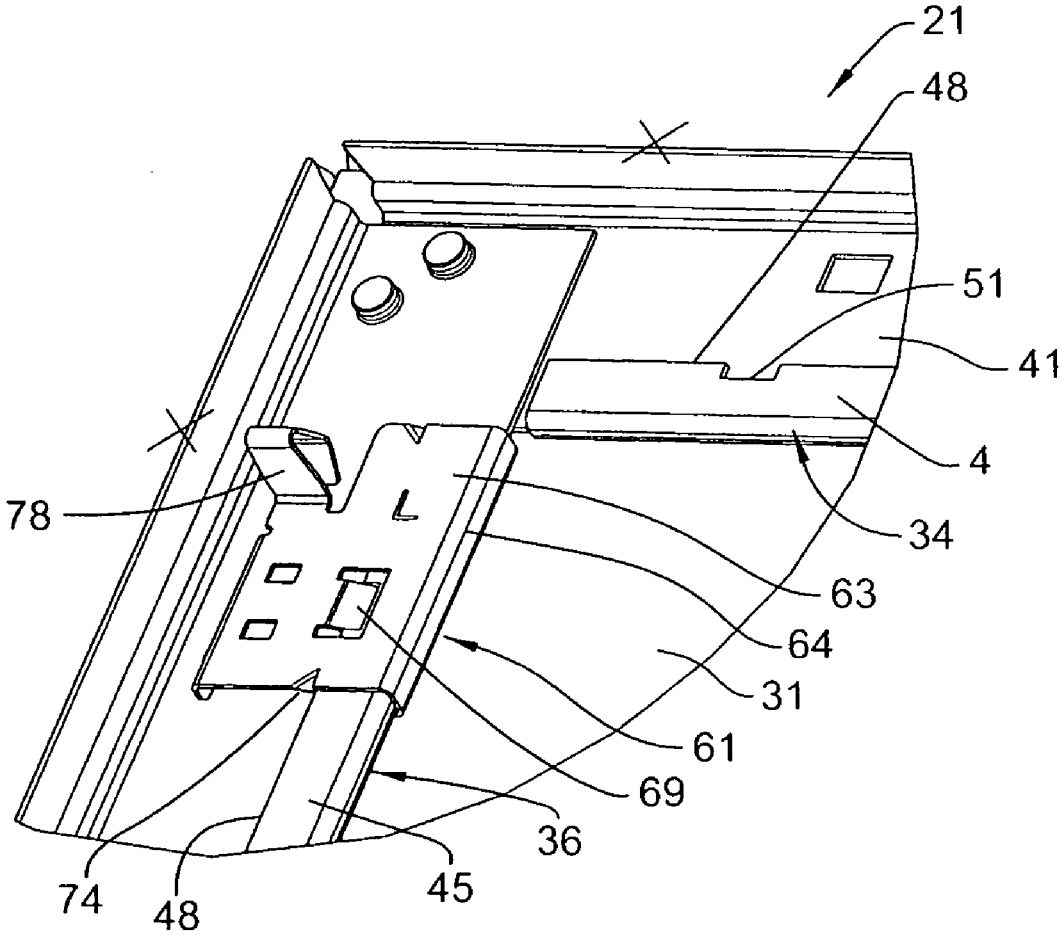
FIG. 21 is an enlarged perspective view showing solely the rear left upper corner of the cover tile.

The frame rails 34-37 are all preferably of substantially identical cross-section and, as illustrated by FIGS. 4 and 17, each frame rail includes a generally planar base wall 41 which extends lengthwise of the frame rail and is positioned in closely adjacent and substantially overlying relationship to the rear face of the pad 31. The base wall 41, adjacent the outer edge thereof has a U- or channel-shaped edge part 42 extending lengthwise therealong for defining the outer extremity of the rail and of the cover tile. This edge part 42 protrudes inwardly away from the base wall 41, and defines thereon an outer leg 43 which projects forwardly and overlaps the outer edge 44 of the pad 31.

Each frame rail also has an inner edge part 45 associated with and extending lengthwise along the inner edge of the base wall 41. This inner edge part 45 is generally L-shaped in cross-section and includes a first leg or flange 46 which projects transversely inwardly (i.e. rearwardly) from the base wall 41, with the flange 46 joining to a second flange or leg 47 which protrudes transversely from the flange 46 so as to be disposed in generally parallel but rearwardly spaced relationship from the base wall 41. This rearward flange 47 projects outwardly toward the peripheral edge of the pad 31 and terminating at a free edge 48. This inner L-shaped edge part 45 and its cooperation with the base wall 41 causes the inner edge of the frame rail to have a generally U-shaped configuration which opens in a direction toward the adjacent free edge of the pad. This inner edge part 45, in the lengthwise direction of the rail, terminates at an end edge 49 which is spaced inwardly from the corresponding end edge of the outer edge part 42 so as to permit the horizontal and vertical frame rails, where they meet at the corner, to define a substantially continuous ring-shaped configuration.

The free edge 48 as defined on the rearward leg or flange 47, at a location positioned reasonably close to each end edge 49 thereof, has a positioning notch or cut-out 51 formed therein, which notch 51 opens inwardly from the free edge 48 for a purpose as explained hereinafter.

The cover tile 21, including the pad 31 and the reinforcing frame 33 associated with the back side thereof, is additionally provided with a flexible covering sheet (not shown), such as a cloth, fabric, foil, plastic, vinyl or equivalent, which overlies and is adhesively secured to the front face of the pad 31, with the projecting peripheral edges of the cover sheet being wrapped around the outer edge portions of the frame rails and adhesively secured thereto so as to fixedly join the frame 33 and pad 31 together. See U.S. Ser. No. 11/369,171, as owned by the Assignee hereof, the disclosure of which is incorporated herein by reference.

To permit releasable attachment of the cover tile 21 to the side of the panel frame 12, the rear side of the cover tile 21 is provided, adjacent each corner, with a connector bracket which attaches to the frame 33 and creates a releasable engagement with the panel frame 12. More specifically, the left and right upper corners of the cover tile are respectively provided with connector brackets 61 and 61', and the left and right lower corners of the cover tile are respectively provided with connector brackets 101 and 101'. The brackets 61 and 61' are identical except for being mirror images of one another, and similarly the lower corner brackets 101 and 101' are also identical except for being mirror images of one another. The construction of the brackets is described below.

The connector bracket 61 (or 61'), as illustrated by FIGS. 9-12, includes a main U- or channel-shaped open body 62 defined by respective outer and inner plate-like walls or legs 63 and 64, the latter being cantilevered in generally parallel relationship from an edge or bridge wall 65 which extends transversely, and more specifically perpendicularly, therebetween. The construction defined by the walls 63 and 64, and their joinder by the bridge wall 65, results in the main body 62 having a generally open interior 70 as defined between the parallel walls 63-64, which open interior has a height which generally corresponds to the height associated with the inner edge part 45 formed on each of the frame rails 34-37.

The flat outer side wall 63 of the bracket main body 62 is defined generally between two parallel side edges 66 which project transversely from the bridge wall 65, with the outer side wall 63 extending a substantial distance outwardly away from the bridge wall 65 so as to terminate at a remote edge 67.

Figure 12:
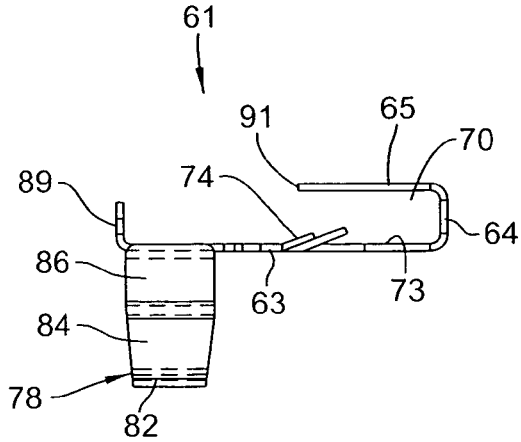
FIG. 12 is a top view of the corner bracket shown in FIG. 10.

The outer side wall 63 has a generally U-shaped opening 68 formed transversely therethrough at a generally central location, that is, in spaced relationship from all of the side edges of the side wall 63. This U-shaped opening 68 surrounds and results in defining a positioning tab 69 which is joined to the outer side wall 63 generally at a bend line 71, with the tab 69 being cantilevered away from this bend line so as to terminate at a free edge 72. The cantilevered direction of this tab 69, i.e. the direction extending from the bend line 71 to the free edge 72, occurs generally toward the bridge wall 65. This positioning tab 69 is physically deformed and more specifically bent inwardly about the bend line 71 so that the free edge 72 of the tab is displaced inwardly a small extent relative to the inner back surface 73 of the outer side wall 63, as illustrated in FIG. 12. This small sideward displacement of the free edge 72 of tab 69 enables the connector bracket 61 to be secured to the respective edge frame member 34-37, as explained hereinafter.

The outer side wall 63 also has at least one, and in the illustrated embodiment two, locking tabs 74 associated therewith. These locking tabs 74 are positioned adjacent opposite side edges 66 of the outer side wall, and have a generally triangular configuration defined on one side by the side edge 66 and on another side by a cutting line 75 which extends transversely through the side wall and projects transversely inwardly a short distance from the side edge 66. The locking tab 74 on its third side is defined by a short bend line 76 which extends angularly between the inner end of the cut 75 and the adjacent outer side edge 66, with the locking tab 74 being deformed or slightly bent inwardly about the bend line 76 so that the tab protrudes inwardly beyond the inner back surface 73 of the side wall 63. The locking tab 74 hence protrudes inwardly in the same direction as the positioning tab 69.

Figures 6, 7, 8:
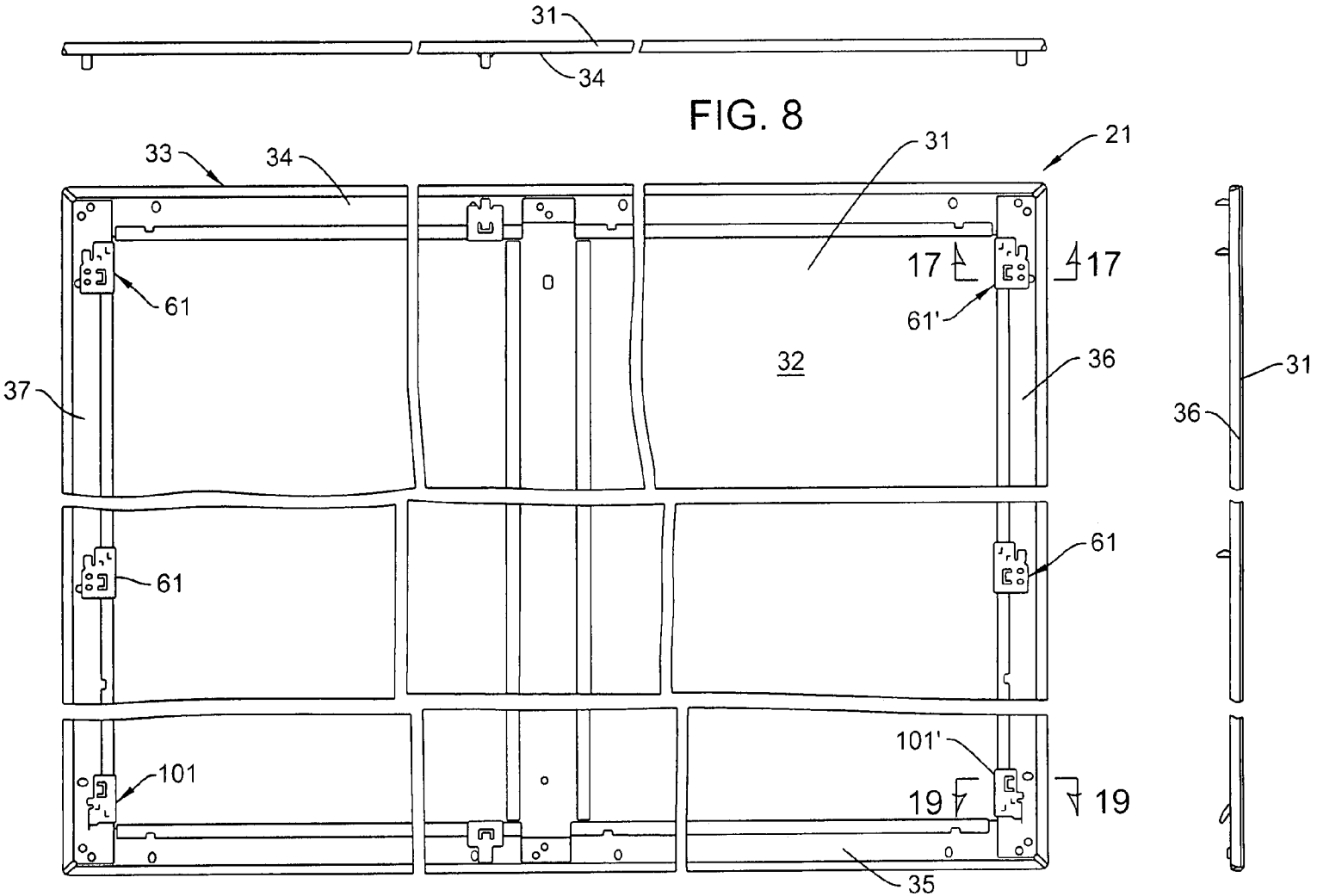
FIG. 6 illustrates the back side of the cover tile similar to FIG. 3 but with the connector brackets mounted thereon adjacent the four corners of the cover tile.
FIGS. 7 and 8 are side and top views, respectively, of the cover tile shown in FIG. 6.
Figure 6A:
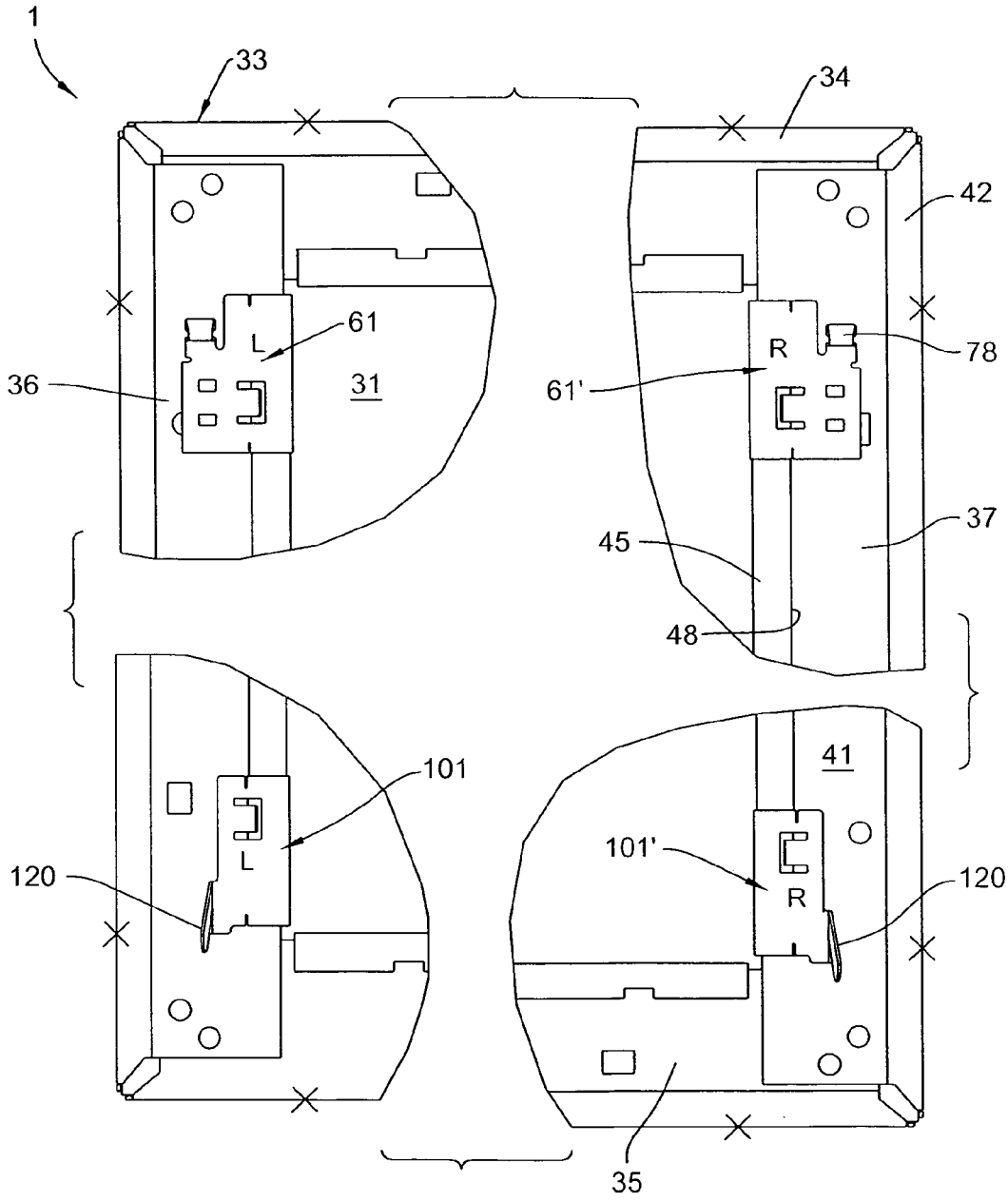
FIG. 6A is an enlarged view corresponding to FIG. 6 but showing only the corners with the brackets attached.
Figure 9:
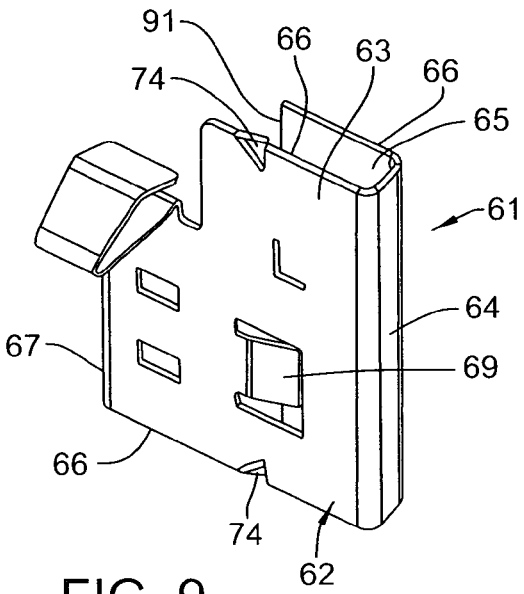
FIG. 9 is a perspective view of the corner bracket which cooperates with an upper corner of the cover tile, namely the upper left corner in FIG. 6.

As illustrated by FIG. 8, the pair of sidewardly-spaced locking tabs 74 are positioned generally on opposite sides of the positioning tab 69, with the cutting lines 75 being aligned and spaced from the edge wall 65 by a slightly greater distance than the spacing between the edge wall 65 and the free edge 72 of the positioning tab.

Figure 11:
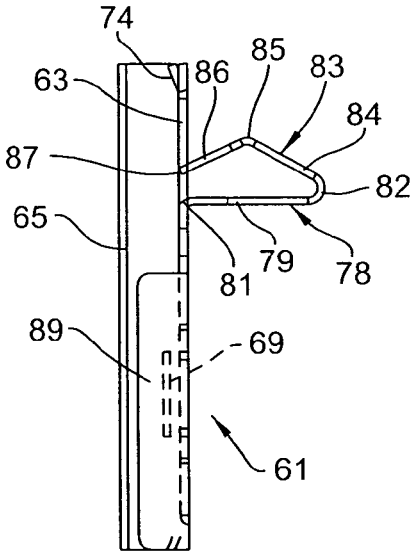
FIG. 11 is a left side elevational view of the corner bracket shown in FIG. 10.
Figure 10:
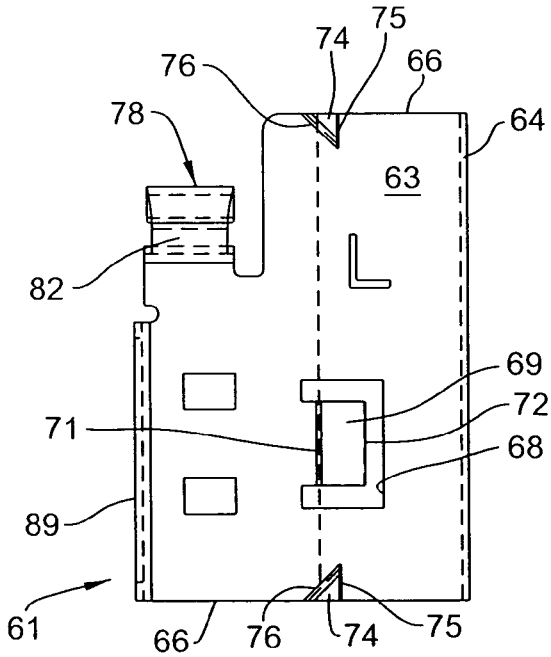
FIG. 10 is a front view of the corner bracket shown in FIG. 9.
Figure 13:
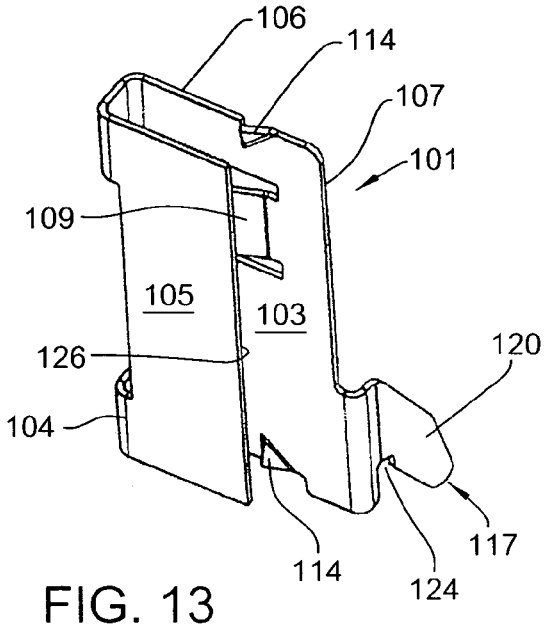
FIG. 13 is a perspective view of the corner bracket associated with a lower corner of the cover tile, specifically the lower left corner of the cover tile illustrated in FIG. 6.

The bracket 61 also has a projection 78, specifically a spring clip, which is carried on the outer side wall 63 and projects transversely outwardly from the plane of the side wall at a location closely adjacent the remote edge 67 thereof. The clip or projection 78 includes a base leg 79 which protrudes generally perpendicularly outwardly away from the side wall 63, being joined thereto through a generally right-angle bend 81. The base leg 79 is cantilevered outwardly and adjacent its outer extremity joins to a nose part 82 of the projection, which nose part 82 is defined by a reverse bend which in turn joins to an upper spring leg 83 which is cantilevered inwardly back toward the outer side wall 63. This spring leg 83 is defined with an arcuate or angled cross-sectional configuration defined by an outer leg part 84 which joins to the nose bend 82 and projects inwardly while being somewhat angled upwardly. The outer leg part 84 then joins through an intermediate bend 85 to an inner leg part 86 which project inwardly and downwardly and terminates at an inner free edge 87, the latter being disposed in close proximity to the plane of the outer side wall 63. The upper spring leg 83 is normally spaced from the base leg 79 and hence can be resiliently deflected downwardly at least a limited extent in a direction toward the base leg 79 when the spring clip 78 is moved into engagement with an opening 22 formed in the wall panel frame. The height of the spring clip 78 when in a resiliently non-deflected condition, as illustrated in FIG. 11, is slightly greater than the height of the opening 22 formed in the panel frame so as to ensure that the upper spring leg 83 resiliently deflects when the clip 78 is inserted into the opening 22, and then expands after passing over the top bend 85 so that the clip provides a barb-like function so as to effect retention of the cover tile to the panel frame.

The outer side wall 63 of connector bracket 61 also has a stop or position limiting flange 89 associated with the remote edge 67 of the outer side wall, which flange 89 is cantilevered generally perpendicularly inwardly from the outer side wall 63 in a direction towards the inner side wall 65. This cantilevered stop flange 89, however, is cantilevered inwardly through only a short transverse distance so that the free edge thereof is normally positioned in close proximity to the base wall 41 of the frame rail when the connector bracket is mounted thereon.

Considering now the lower corner bracket 101 and referring specifically to FIGS. 13-16, this bracket also includes a main U- or channel-shaped open body 102 having sidewardly spaced but generally parallel plate-like outer and inner side walls 103 and 104, respectively, which are transversely joined by a bridge or edge wall 105, whereby the main body 102 defines an opening or recess 110 between the side walls which generally corresponds to the height of the rail edge part 45.

The outer side wall 103 has side edges 106 which project outwardly away from the bridge wall 105, with the cantilevered side wall 103 terminating at a remote edge 107. The outer side wall 103 has a U- or channel-shaped opening 108 extending transversely therethrough at a location spaced inwardly from the edges of the side wall, and this opening 108 surrounds and defines a cantilevered positioning tab 109 which is joined to the side wall 103 at one end by means of a bend line 111, with the cantilevered positioning tab 109 projecting inwardly toward the bridge wall 105 and terminating at a free edge 112. This positioning tab 109 is bent or deformed inwardly from the plane of the side wall 103 in a direction generally toward the other side 104, whereby the free edge 112 is positioned adjacent and projects slightly inwardly relative to the inner side surface 113 of the side wall 103.

The outer side wall 103 of bracket 101 also has a pair of sidewardly spaced locking tabs 114 formed therein directly adjacent the opposite side edges 106 thereof, each said locking tab 114 being defined by a cutting line 115 which extends a small distance transversely inwardly from the respective side edge 106, and by a bend line 116 which extends in angled relationship between the inner end of the cut line 115 and the adjacent side edge 106. Each tab 114 is bent inwardly a small amount about the bend line 116 so that the tab projects inwardly beyond the inner side surface 113.

The formation of the outer side wall 103 and specifically the formation of the positioning tab 109 and locking tabs 114 thereon substantially corresponds to the equivalent structure associated with the outer side wall associated with the top bracket 61, whereby further detailed description thereof is believed unnecessary.

The corner bracket 101, adjacent the remote edge 107 of the outer side wall 103, also has a projection 117, specifically a clip part, cantilevered transversely outwardly therefrom for cooperation with an opening 22 associated with the panel frame. The projection 117 as associated with the lower corner bracket 101 is somewhat differently configured in comparison to the upper corner bracket 61 in that the clip part 117 is shaped to function as a hook, rather than as a spring clip.

More specifically, the clip part 117 includes a plate-like bridge part 118 which is bent from the side wall 103 and projects generally perpendicularly outwardly away from the remote edge 107 through a small extent. This bridge part 118 in turn joins to a flat engaging part 120, formed generally as a finger-like hook, which is formed as an elongate cantilever which projects outwardly and downwardly. This finger-like hook 120 is defined by vertically spaced top and bottom edges 121 and 122, respectively, which both slope downwardly as they project outwardly, with these edges terminating at a rounded lower free end 123, the latter defining the nose of the hook part 120. The lower edge 121 of the hook part, where it transitions to the bridge part 118, has a small slot 123 opening upwardly through a small extent, which slot is sized to accommodate the wall thickness of the panel frame as defined adjacent the hook-accommodating opening 22 formed therein.

Figure 16:
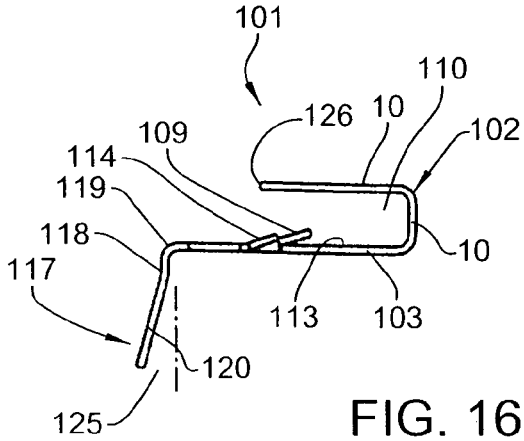
FIG. 16 is a top view of the corner bracket illustrated in FIG. 14.
Figure 15:
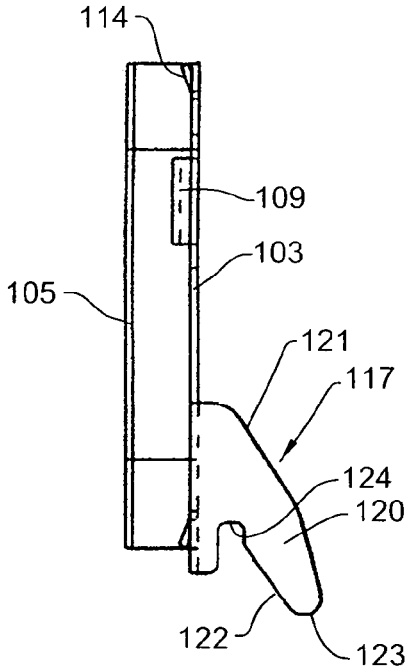
FIG. 15 is a left side elevational view of the corner bracket illustrated in FIG. 14.
Figure 14:
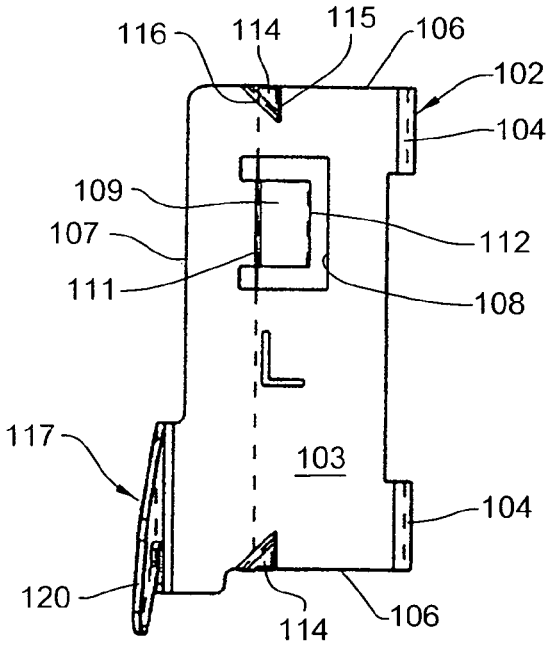
FIG. 14 is a front view of the corner bracket illustrated in FIG. 13.
Figure 18:
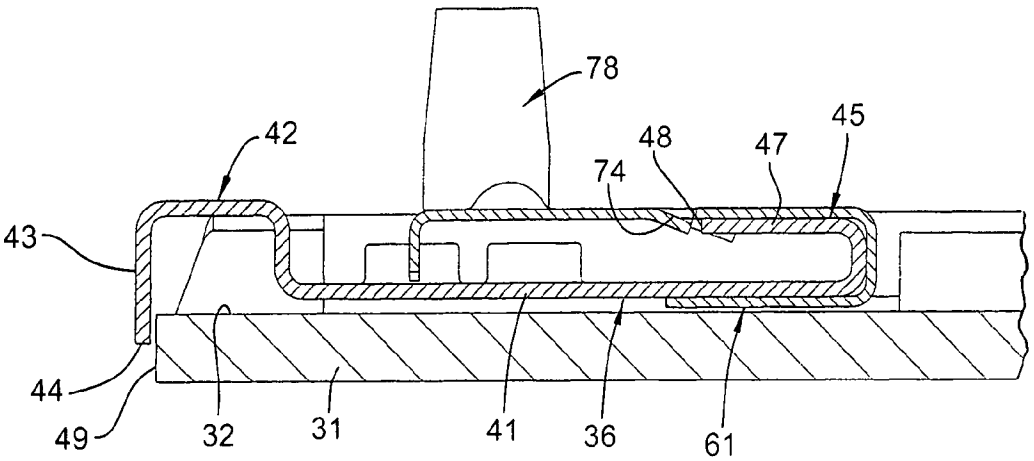
FIG. 18 is a view similar to FIG. 17 but sectioned generally through the locking tab.

As illustrated by FIG. 16, the plane of the hook part 120, where it cantilevers outwardly from the bridge part 118, extends at a small angle relative to the perpendicular relationship defined by the bridge part 118 as it extends perpendicularly from the plane of the side wall 103. This angle, designated 125 in FIG. 16, is normally in the range of 10 degrees to 20 degrees, preferably about 15 degrees. This hence results in the free end of the hook part 120, as defined by the nose 123, being spaced a further distance from the bridge wall 105 so that, as explained hereinafter, this facilitates initial lead-in of the hook part 120 into the opening 22 in the wall panel frame, with the tapered or angularity of this hook part 120 effectively causing a proper alignment of the cover tile on the frame due to the fact that the lower brackets 101 and 101' as disposed adjacent opposite lower corners of the cover tile have the hook parts 120 thereof angled in opposite direction, and hence the oppositely angled hook parts effectively cause proper centering and positioning of the cover tile when it is moved into engagement with the wall panel frame.

The other or inner side wall 104 of the bracket 101 is preferably formed as a generally flat and planar plate which is free of tabs, and which terminates in a free edge 126 which is spaced significantly inwardly in closer proximity to the bridge or edge wall 105 than the remote edge of the outer side wall 103.

In accordance with a preferred construction of the connector bracket of the present invention, such as the brackets 61 and 101, each bracket is preferably formed as a monolithic one-piece member by being formed from thin metal plate, preferably thin steel sheet, with the member being initially cut or stamped from a flat plate to create a suitable blank, which blank is then suitably shaped so as to result in the configuration of the bracket 61 or 101 as described above and as illustrated herein.

The mounting of the corner clips on the frame of the cover tile, and the mounting of the cover tile onto the frame of the wall panel, will now be described in greater detail to ensure a complete understanding thereof.

After the cover tile 21 has been assembled by initially forming the reinforcing frame 33, positioning the frame 33 adjacent the back side of the pad 31, and then wrapping the fabric covering as adhered to the front face of the pad around the pad edges and around the edges of the frame rails so as to adhesively secure the fabric to the frame rails and hence create a unitary construction for the cover tile, then the connector brackets are attached to the four corners of the frame 33. This attachment of the corner brackets to the cover tile may occur in the factory, or may ultimately be carried out at the job site.

To mount the connector bracket 61 to the rear upper left corner of the cover tile, the bracket is positioned inwardly of the upper corner, and is then slidably displaced horizontally outwardly so that the channel-shaped body 62 of the bracket slidably telescopes over and around the inner edge part 45 of the left edge frame element 37. During the slidable fitting of the body part 52 over the edge channel part 45, the plate-like outer side wall 63 resiliently deflects to allow passage of the tabs 69 and 74 over the flange 47. When the channel-shaped body 62 is substantially fully seated over the inner edge part 45, the locking tabs 74 snap downwardly so as to overlap the free edge 48 of the flange 47, thereby restricting reverse or withdrawal movement of the bracket. At the same time, the positioning tab 69 also snaps downwardly into the positioning notch 51 (assuming that it is properly aligned therewith), or if misaligned then the bracket is forcibly moved lengthwise along the frame rail until the positioning tab 69 aligns with and moves transversely into the positioning notch 51. With the positioning tab 69 and locking tabs 74 properly positioned, the bracket 61 is now properly positioned and retained on the edge rail 37 adjacent the upper end thereof, and the projection (i.e. the spring clip) 78 protrudes rearwardly at a desired location for cooperation with an upright rail 15, 16 of the panel frame. In addition, the edge flange 91 is positioned so that it protrudes downwardly into close proximity with the base wall 41 of the edge rail so as to prevent any significant inward resilient deflection of the plate-like outer side wall 63.

The lower left corner bracket 101 is mounted onto the lower end of the left side edge rail 37 following the same technique as described above relative to the upper corner bracket 61.

Once all four corner brackets have been properly mounted, the tile can then be mounted on an appropriate sized panel frame by initially positioning the tile adjacent the panel frame so that the protruding lower hooks 120 as provided adjacent the opposite lower corners can be aligned with and partially inserted into the frame openings 22. As the hooks 120 are inserted more fully into the openings 22, the angularity of the hooks and the converging relationship between the pair of hooks as they extend toward the back side of the cover tile effectively causes a sideward centering of the cover tile so as to effectively result in the hooks, when fully seated within the openings, to substantially bear against the inner edge of the respective opening.

After the hooks associated with the lower brackets 101, 101' have been seated in their respective openings 22, then the cover tile 21 is manually swung inwardly toward the wall panel frame, causing the spring clips 78 on the upper brackets to enter into their respective frame openings 22. Since the vertical dimension of the spring clips 78 slightly exceeds the vertical dimension of the frame openings 22, the spring clips 78 undergo a limited resilient deflection as they are manually forced through the openings. Due to the curved or angular shape of the top leg of the spring clips 78, the passage of the projections through the openings causes the spring clips to resiliently expand to hence create an engagement which retains the upper spring clips within the openings and hence retains the cover tile in snug engagement with the face of the panel frame.

While the aforementioned description relates principally to the clips which are provided at the upper and lower corners of the cover tile, it will be appreciated that additional clips may be provided at intermediate locations along both the horizontal and vertical frame rails so as to provide any needed engagement with the panel frame, specifically when the cover tile has large vertical and/or horizontal dimensions. When additional connector brackets are provided for use on the horizontal frame rails, it will be appreciated that such clips will be similar to the corner clips 61 in terms of the manner of mounting the clips on the rails, but the brackets will be modified to the extent necessary so as to enable cooperation with the panel frame due to the different positional orientation of the clip when mounted on the frame of the cover tile.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A wall panel tile for connection to one side of a panel frame for an upright wall panel, comprising:

a main upright tile body having opposite-facing front and rear sides that have height and width dimensions which are large relative to a thickness dimension defined transverse to said main tile body, said front and rear sides defining an outer free edge extending about an inner tile section;

an elongate rigid connector member which extends lengthwise in a lengthwise direction between opposite ends, said connector member being fixed to said main tile body rearwardly adjacent said rear side thereof and extending lengthwise along said free edge of said main tile body, which said free edge is disposed outwardly adjacent to said connector member, the outwardly direction extending away from the center of the main tile body and towards the outer free edge thereof;

said connector member having a channel-shaped connector part which extends lengthwise and has an outwardly projecting connector leg terminating at a shoulder which outwardly faces the adjacent free edge of said main body in an outward direction to define an outward facing shoulder surface;

said connector part, in the vicinity of each said opposite end thereof, having a positioning notch which is formed in said shoulder and opens transversely away from said tile body;

a pair of one-piece connector brackets mounted on said connector member adjacent said opposite ends thereof for permitting releasable engagement with the panel frame;

each said connector bracket including an open U-shaped body having a bracket interior sized to outwardly slidably engage said U-shaped body in said outward direction over the connector part of the connector member, said U-shaped body having one side thereof defined by a plate-like leg part which is cantilevered from the connector part so as to extend outwardly toward said adjacent free edge of said main body;

said leg part having a transversely deformed locking tab which is an integral and monolithic part of said leg part and which has a tab surface that faces in an inward direction opposite said outward direction so that said locking tab is disposed in an overlapping position outwardly adjacent to said shoulder to prevent reverse inward sliding disengagement of said U-shaped body from the connector part, said locking tab being spaced in the lengthwise direction away from said positioning notch when the connector bracket is mounted on the connector member;

said leg part also having a transversely deformed positioning tab which is spaced in the lengthwise direction away from said locking tab and is cantilevered so as to extend inwardly generally away from said adjacent free edge for engagement within said positioning notch when the bracket is mounted on the connector member, said locking tab being engaged with said shoulder outside of said positioning notch while said positioning tab is engaged transversely within said positioning notch; and said leg part also having a frame-engaging projection cantilevered transversely outwardly from said leg part in a direction away from said U-shaped body, said projection being configured for engagement within an opening formed in said panel frame for attaching said cover tile to said panel frame.

2. The cover tile according to claim 1, wherein said leg part has a pair of said locking tabs formed therein in sidewardly spaced relationship so as to be spaced apart lengthwise relative to said connector member, and said positioning tab is positioned sidewardly between said pair of locking tabs so as to be separated from said locking tabs.

3. A cover tile according to claim 2, wherein said U-shaped body has a second plate-like leg part cantilevered in generally parallel relationship to said one leg part, said second leg part projecting toward said adjacent free edge through a smaller distance than said one leg part.

4. A cover tile according to claim 2, wherein said bracket is formed as an integral, monolithic, one-piece structure shaped from a single piece of thin metal plate.

5. A cover tile according to claim 2, wherein said frame-engaging projection is defined by a single strip of thin metal plate bent into an open channel-like shape which is resiliently deformable to permit engagement within an opening in said panel frame.

6. A cover tile according to claim 2, wherein said frame-engaging projection is cantilevered downwardly and defines a hook shape for engagement within an opening in the panel frame.

7. A cover tile according to claim 2, wherein said channel-shaped connector part includes a base leg which rearwardly overlies a rear surface of said main body, a bight joined to said base leg and projecting transversely rearwardly thereof, and said connector leg joined to said bight and cantilevered outwardly toward the adjacent free edge of said main body in substantially parallel relationship to said base leg, said connector leg terminating at an outer edge which is spaced from the adjacent free edge of the main body and which defines said shoulder, said positioning notch being formed in said outer edge.

8. A cover tile according to claim 7, wherein said U-shaped body has a second plate-like leg part cantilevered in generally parallel relationship to said one leg part, said second leg part projecting toward said adjacent free edge thereof through a smaller distance than said one leg part; and wherein said second leg part of said bracket is positioned between said connector part and the rear surface of said main tile body, and said one leg part overlies said outer leg of said connector part and is cantilevered beyond said shoulder and terminates at an outer edge positioned more closely adjacent the adjacent free edge of the main tile body, and said projection being located between said shoulder and the outer edge of said one leg part.

9. A cover tile according to claim 1, wherein the locking tab is defined on one side thereof by a slit which is formed in a side edge of said leg part and which opens inwardly from said side edge of said leg part.

10. A cover tile according to claim 9, wherein said leg part has an enlarged U-shaped clearance opening formed therethrough in surrounding relationship to said positioning tab.

11. A cover tile according to claim 10, wherein said leg part has a pair of said locking tabs formed therein in sidewardly spaced relationship so as to be spaced apart lengthwise relative to said connector member, and said positioning tab is positioned sidewardly between said pair of locking tabs so as to be separated from said locking tabs.

12. A cover tile for attachment to one side of an upright wall panel frame having attachment openings associated with the one side thereof, said cover tile comprising:

a generally rectangular, thin main body having front and back surfaces which face sidewardly in opposite front and rear directions and define a pair of parallel outer free edges from which said front and back surfaces extend inwardly;

a pair of elongate and substantially parallel reinforcing rails disposed rearwardly adjacent and overlying the back surface of said rectangular main body adjacent a respective one of said pair of parallel outer free edges defined on said main body;

each said rail including in cross section a base wall which substantially rearwardly overlies the back surface in opposing relation therewith, and an inner edge channel part having a first leg contiguous with the base wall, the first leg of the inner edge channel part protruding rearwardly relative to the base wall and having a channel part back leg on said first leg which is spaced rearwardly from and projects generally parallel with said base wall, said channel part back leg being cantilevered toward the adjacent free edge of said main body but terminating at an outer edge which is spaced inwardly from the adjacent free edge of said main body and is spaced rearwardly from said base wall, said channel part back leg having a positioning notch opening rearwardly and outwardly from the outer edge thereof wherein the outer edge faces outwardly toward said outer free edge of said main body;

a bracket fixedly mounted on said rail adjacent each end thereof for permitting releasable attachment to a panel frame, said bracket comprising a monolithic one-piece member formed entirely from a thin metal plate;

said bracket having an open U-shaped body defined by generally parallel front and back bracket leg parts which are cantilevered in generally parallel relationship from a bight part and are sidewardly spaced apart from each other to define an open-sided bracket interior, the sideward spacing between said front and back bracket leg parts enabling the U-shaped body to be transversely slidably engaged in an outward direction over said edge channel part of said rail, which said edge channel part is received in said bracket interior so that the front and back bracket leg parts protrude outwardly toward the adjacent free edge of said main body and respectively overlap said base wall and said channel part back leg of said edge channel part;

said back bracket leg part of said bracket having a positioning tab cantilevered generally toward the bight part and transversely angled into said bracket interior for protrusion into the positioning notch formed in the channel part back leg of said edge channel part to prevent the bracket from moving along the rail in the lengthwise extent thereof;

said back bracket leg part having a locking tab deformed transversely therefrom at a location spaced lengthwise from the bight part and said positioning tab so that the locking tab is spaced from said positioning notch and protrudes in front of and faces inwardly toward the outer edge of the channel part back leg to prevent the bracket from being transversely slidably disengaged from the rail in an inward direction; and said back bracket leg part of said bracket also having a frame-engaging projection transversely cantilevered rearwardly for insertion into an opening in the panel frame, said projection being configured for engagement with an edge wall defining the opening.

13. A cover tile according to claim 12, wherein the back bracket leg part of the bracket has a pair of said locking tabs deformed forwardly therefrom into the bracket interior and adjacent opposite side edges of the back bracket leg part for cooperation with the outer edge of the channel part back leg at two sidewardly spaced locations, said positioning tab being positioned sidewardly between said locking tabs, and said positioning notch being located between said two locations.

14. A cover tile according to claim 12, wherein said positioning notch is defined by an inner notch edge spaced inwardly of said outer edge of said channel part back leg, and side notch edges extending outwardly between said inner notch edge and said outer edge of said channel part back leg, said positioning tab having a width proximate said positioning notch such that said notch side edges are disposed proximate opposite sides of said positioning tab to restrain movement of said bracket lengthwise along said rail.

15. A cover tile according to claim 14, wherein said locking tab is disposed at said outer edge of said channel part back leg outwardly of said inner notch edge.

16. A cover tile according to claim 12, wherein said back bracket leg part of said bracket projects outwardly beyond said outer edge and has a stop flange cantilevered forwardly and terminating in close proximity to said base wall.

* * * * *

UNITED STATES PATENT AND TRADEMARK OFFICE

CERTIFICATE OF CORRECTION

PATENT NO. : 7,856,777 B2
APPLICATION NO. : 11/982878
DATED : December 28, 2010
INVENTOR(S) : Alex Lamfers et al.

It is certified that error appears in the above-identified patent and that said Letters Patent is hereby corrected as shown below:

Column 9, line 62; change "defined transverse to said main tile body, said front and rear sides defining an outer free edge extending about an inner tile section;" to --defined transverse to said front and rear sides, said main tile body defining an outer free edge extending about an inner tile section;--

Signed and Sealed this
Eighth Day of March, 2011

David J. Kappos

David J. Kappos
*Director of the United States Patent and Trademark Office*